United States Patent [19]

Menendez et al.

[11] 3,968,032

[45] July 6, 1976

[54] PROCESS FOR CONCENTRATING LEAD AND SILVER BY FLOTATION IN PRODUCTS WHICH CONTAIN OXIDIZED LEAD

[75] Inventors: Francisco Javier Sitges Menendez; Vicente Arregui Fernandez; Macario Quesada Quintana, all of Salinas-Castrillon (Oviedo), Spain

[73] Assignee: Asturiana de Zinc S.A., Castrillon (Oviedo), Spain

[22] Filed: Jan. 22, 1974

[21] Appl. No.: 435,409

[30] Foreign Application Priority Data

Jan. 27, 1973 Spain ..... 411058

[52] U.S. Cl. ..... 209/166; 209/167

[51] Int. Cl.[2] ..... B03D 1/02

[58] Field of Search ..... 209/166, 167

[56] References Cited

UNITED STATES PATENTS

| | | | |
|---|---|---|---|
| 1,142,821 | 6/1915 | Lavens | 209/167 |
| 1,182,890 | 8/1916 | Bradford | 209/167 |
| 1,236,934 | 8/1917 | Higgins | 209/167 |
| 1,269,157 | 6/1918 | Callow | 209/167 |
| 1,733,570 | 10/1929 | Wilson | 209/167 |
| 1,842,400 | 1/1932 | Hahn | 209/167 X |
| 2,029,156 | 1/1936 | Christmann | 209/166 |
| 2,150,114 | 3/1939 | Anderson | 209/167 |
| 2,196,233 | 4/1940 | Terry | 209/167 |
| 2,287,274 | 6/1942 | Ralston | 209/167 |
| 2,595,076 | 4/1952 | Hendrickson | 209/167 X |
| 2,660,307 | 11/1953 | Allen | 209/167 |

FOREIGN PATENTS OR APPLICATIONS

| | | | |
|---|---|---|---|
| 142,233 | 4/1961 | U.S.S.R. | 209/167 |

*Primary Examiner*—Robert Halper
*Attorney, Agent, or Firm*—Wigman & Cohen

[57] ABSTRACT

A flotation process for recovering lead and silver values from electrolytic zinc residues is disclosed.

7 Claims, 2 Drawing Figures

PROCESS FOR CONCENTRATING LEAD AND SILVER BY FLOTATION IN PRODUCTS WHICH CONTAIN OXIDIZED LEAD

BACKGROUND OF THE INVENTION

The present invention relates to a process for reclaiming silver and lead by flotation in products containing oxidized lead such as lead sulfate. More particularly, the present flotation process is for recovering silver and lead contained in the residue from electrolytic zinc production using either zinc concentrates or complex concentrates as the raw material.

By zinc concentrates we consider those commonly accepted as such, that is, those in which the zinc concentration is sufficiently high to allow their reclaiming by electrolysis.

Complex concentrates are those obtained by bulk flotation of complex sulphide ores, those commonly called "middlings" in a selective flotation of same or other similar ones. Analysis of these concentrates gives values which usually vary according to the following figures : 10–45% Zn; 3–40% Pb; 0–25% Cu; 0–5,000 gr/m.t. Ag; 5–30% Fe.

It is known that zinc can be obtained from zinc sulphide concentrates by roasting these concentrates to obtain a calcined product which contains oxidized zinc. It is also known that in the standard process for obtaining zinc by electrolysis, the zinc oxide is dissolved in an aqueous sulphuric acid solution. The zinc sulphate solution obtained is purified and subsequently electrolized to reclaim the zinc, at the same time as the oxygen liberated during electrolysis produces sulphuric acid which is used to dissolve more zinc oxide. This acid, known as "spent electrolyte" or "return acid" has a concentration which generally varies between 150–200 gr./l. of $H_2SO_4$.

During the roasting process both of the zinc concentrates and of the complex concentrates, the iron combines with the rest of the existing metals giving compounds, "ferrites", which generally agree to the formula of $MeO.Fe_2O_3$, in which Me represents any of the metals accompanying the iron in the concentrates.

The $MeO.Fe_2O_3$ ferrites are insoluble in the aqueous sulphuric acid solution used in lixiviation of the zinc oxide, in standard conditions existing in lixiviation stages for reclaiming zinc by electrolysis. The greater the concentration in iron of the concentrated ore, the greater is the quantity of metals which become insoluble during roasting. Consequently, from the lixiviation stages a residue is obtained whose zinc content can range within very wide margins, we could say from 15 to 35%, according to whether the lixiviated material is standard zinc concentrate, or on the other hand whether it is a complex concentrate.

There are several processes which have been proposed over the last few years for reclaiming zinc and the rest of the valuable metals contained in these residues. Some of them have gone no further than mere laboratory tests; others have found adequate industrial application. Such is the case covered by U.S. Pat. No. 3,434,798, granted on Mar. 25, 1969.

In all the processes proposed, the solution of zinc and iron is accompanied by the simultaneous solution, and in high proportions, of other valuable elements, such as Cd, Cu, etc.

In all the processes, there is a final insoluble residue containing a very high percentage of Pb and Ag, and other precious metals contained in the original concentrates. The final destination of this insoluble residue, from reclaiming zinc and other valuable metals from the residue of obtaining electrolytic zinc from zinc ore concentrates and complex concentrates, is, almost invariably, to be sent to a lead foundry or a shaft furnace. Until now no process by flotation has been known on an industrial scale designed to reclaim lead, silver and other noble metals from the final insoluble residues from reclaiming zinc or other metals.

SUMMARY OF THE INVENTION

Accordingly, the aim of the present invention is to provide a process by means of which lead and silver can be reclaimed by flotation, from the residue obtained from the production of electrolytic zinc or other metals, using as raw material, either concentrates of the metal concerned, or complex concentrates of the metal in question, reaching highly satisfactory yields.

In the applicants case, in whose laboratories and plant all the research and tests have been carried out, the two types of concentrates mentioned above were used in the electrolytic zinc plant as raw material.

In both cases, after the lixiviation stage and of applying the residues obtained from this lixiviation stage, in the process disclosed in the afore-mentioned U.S. Patent No. 3,434,798, a final product is obtained whose normal analysis is as follows:

| | | | |
|---|---|---|---|
| Total Zn | 1.49% | As- 0.006% | Mn- 0.34% |
| Total Pb | 18.00% | Sb- 0.01 % | Ni- 0.0005% |
| Total Cd | 0.011% | Ge- 0.0005% | |
| Total Fe | 3.00% | Ag 650 gr./m.t. | |

CaO = 15.85%; MgO = 1.45%; Total S- = 15.80%
$S\text{-}SO_4$ = 15.80; Insoluble R. = 4.68%

These percentages can vary within very wide limits, always depending on the original composition of the concentrates.

In this residue the lead is found almost entirely in the form of sulphate.

The process proposed, according to the invention, is based on the fact that the silver compounds, in the form in which they come in said residues, and the lead sulphate can be reclaimed by flotation, when this takes place in a suitable medium and with an equally suitable technique.

For the process of the invention, it is advisable and at times necessary, to remove the elements in solution in said residues before starting flotation.

Flotation, according to the process proposed, can be done in one or two stages, therefore obtaining one or two concentrates, respectively.

The flotation system chosen, in one or two stages, will depend on the metal content of the residues and basically on the Pb/Zn and Pb elemental S ratio, as well as the silver contained in these residues. It is therefore advisable to carry out flotation in two stages when the zinc and elemental sulphur are high compared with the lead in the residue to be treated. On the other hand, when the percentage of zinc and elemental sulphur is very low with respect to the lead, the process can be used in a single stage.

When flotation is carried out in two stages, two concentrates are obtained, in the first of which a large part of the silver is reclaimed accompanied by elemental sulphur and zinc, whereas in the second concentrate, the lead sulphate is reclaimed and the rest of the silver.

When flotation takes place in two stages, in that corresponding to reclaiming the silver, flotation is carried out preferably in an acid medium.

The acidity level of this stage will influence decisively the quality of the silver concentrate, and even affect reclaiming the lead in the following stage.

In this first stage, after the slurry has been prepared at a suitable percentage of solids, which although it can vary, generally will be from 20 to 25%, and after fixing the best acidity level, the slurry is taken to a tank or conditioner where the suitable reagents are added to obtain flotation of the silver, elemental sulphur and zinc compounds.

The best level of acidity will range between a pH of 2 and 4.5.

Although the acidity level can vary between very wide limits, regarding flotation of silver, this flotation can even be carried out in a neutral or alkaline medium, in order to obtain maximum separation of the lead, and silver, and subsequently the better flotation of the lead, it is necessary to fix the best level of acidity, which will range between a pH from 2 to 4.5.

As a collector reagent, xanthates, dithiophosphates or others can be used, but preferably reagents should be used which do not collect the lead in the first stage of flotation.

The addition of dispersants may also be useful, such as sodium silicate or others.

A frothing reagent will also be used, if necessary, to produce sufficient foam for efficient flotation.

The slurry flows from the conditioner tank to some flotation cells where the operation commonly known as "rougher" takes place.

The foam of this "rougher" is recleaned afterwards several times, preferably between one and three stages.

The residues of these recleaners, will normally be joined to the residues of the "rougher" operation, but they can also be added at the beginning of the "rougher" or even be removed with the final tailings of the treatment.

The level of acidity in the recleaning influences the quality of the final silver concentrate, so it is advisable to keep the best acidity level mentioned above.

The quality of this concentrate is very variable, and always depends not only on the silver content of the original slurry, but on the iron content and especially on the zinc and elemental sulphur contents of said slurry.

With this concentrate, the classical operations are carried out of all floated products: decantation, filtration and drying.

The dry product is subjected to calcination to enrich it in silver and zinc through the elemental sulphur coming away in the form of $SO_2$, which can subsequently be used in other industrial processes.

In calcination, fuel consumption is minimum, as it is only necessary to start combustion.

The residues of the "rougher" cells, together with the residues of the recleaners, as the case may be, pass on to a conditioner where, by means of a sulphurizing agent, the lead sulphate is activated so that it can be collected by the collector reagents commonly used in mineral flotation.

Sodium sulphide is used preferably as a sulphurizing agent.

Dispersant reagents or specific depressors of the compounds accompanying the lead sulphate can be added in the conditioner or later in the "rougher" cells, although this is not generally necessary.

The level of acidity of the slurry entering the conditioner where the activation is checked of the lead sulphate is of decisive importance in this activation, and should be kept at the afore-mentioned best acidity level. Otherwise lead sulphate reclaiming drops considerably, reaching such a point, when the acidity level is a long way from the optimum level, that this drop would clearly make this operation uneconomical.

After sulphurizing, the slurry passes from the conditioner to some flotation cells where the collector and frothing reagents are added, if the latter are necessary to produce sufficient foam for efficient flotation.

In these cells, a product commonly known as lead sulphate "rougher" is floated.

Xanthates and/or dithiophosphates will preferably be used as collectors.

As frothing agents, reagents of this type which have no collector properties should preferably be used.

Both the collectors reagents and the frothing agents, when the latter are necessary, should be added preferably gradually, a small amount at a time.

In some cases, the addition of ammonium sulphate is useful.

The floated "rougher" product passes to other cells, where a product is again floated which is commonly called lead sulphate cleaner or recleaning.

This cleaning or recleaning operation can be repeated several times. Usually from one to three times is sufficient.

In these recleaning oerations, it is advisable to keep the best acidity level between the afore-mentioned margins.

In the recleaning, sulphurizing agents can be added, as well as collector and dispersant reagents or specific depressors of the compounds accompanying the lead sulphate, although it will not be necessary.

The residues of the "rougher" operation are the so-called tailings in flotation plants.

The residues of the recleaner cells can be added again at the beginning of the "rougher" or at the beginning of another operation prior to recleaning, provided they are less than two, or all or some of them can be added to the tailings.

Adding the recleaning residues to the sterile will usually be decided by the impurities of the "rougher" flotation product.

If the "rougher" product has a high iron content, it is better to add the residues to the tailings, to obtain a good quality lead sulphate.

The final lead sulphate product is the product floated in the last recleaner cells operation.

The quality of this concentrate or final product varies depending, apart from the lead content of the original material concerned, on the other compounds which may impurify said concentrate.

If in the original ore, the zinc content is low compared with its lead content, the product of the silver flotation, once calcined, can be added to the product of the lead sulphate flotation, thereby enriching in silver the lead sulphate and improving the lead yield.

The residues of the first "rougher" stage, both in reclaiming silver and lead, can continue to another flotation stage, where the floated product, called "blends", is added at the head of the relevant "rougher" stage. The residues of this second flotation, which come from the silver "rougher" would pass to the conditioner where activation of the lead starts, whereas those which come from the lead "rougher" form sterile residues which are removed.

As mentioned above, silver and lead flotation can be carried out together.

In this case, the same process should be followed as disclosed for lead sulphate flotation.

Normally, it is not advisable to float silver and lead sulphate compounds together, as small quantities of the sulphurizing agent in excess can cause great losses of silver.

During the research period, it was possible to determine quite accurately the factors which to a greater or lesser extent influence both the work setup and the products obtained from flotation. It is clear that most of these factors depend on the composition of the residue sent to flotation which in turn likewise depends on both the composition of the original zinc concentrate, and the process followed in its treatment.

We can speak of two types of products as extreme cases.

a. Pb/Ag residues with low iron and zinc contents.

b. Pb/Ag residues with high iron content.

In some cases, when the iron content is high, most of this iron comes in the form of basic complex sulphate (jarosite).

When the Pb/Ag residues have a high iron content, sometimes this iron can impurify the lead and silver concentrates.

In this case, iron lixiviation increases the lead and silver concentration in the final products to acceptable values.

An average balance obtained in an industrial plant following the process of the invention with two stages was as follows :

| PRODUCTS | % WEIGHT | % Pb | Ag. gr/m.t. | % Zn | % Fe |
|---|---|---|---|---|---|
| Ag concentrate | | 5.5 | 14,300 | 30.2 | 2.3 |
| Pb concentrate | | 55.5 | 900 | 3.6 | 3.2 |
| Tailings | | 4.3 | 150 | 1.5 | 1.8 |
| Feed | | 27.9 | 1,202 | 3:9 | 2.5 |

Distribution %

| PRODUCTS | % WEIGHT | % Pb | Ag. gr/m.t. | % Zn | % Fe |
|---|---|---|---|---|---|
| Ag concentrate | 5.0 | 1.00 | 59.45 | 38.70 | 4.66 |
| Pb concentrate | 46.0 | 91.46 | 34.42 | 42.45 | 59.61 |
| Tailings | 49.0 | 7.54 | 6.13 | 18.85 | 35.73 |
| Feed | 100.0 | 100.00 | 100.00 | 100.00 | 100.00 |

The silver concentrate did not calcine.

An average balance, when flotation was carried out in a single stage, is given below :

| ANALYSIS PRODUCTS | % WEIGHT | % Pb | Ag. gr/m.t. | % Zinc | % Fe |
|---|---|---|---|---|---|
| Ag and Pb concentrate | | 50.6 | 2,214 | 6.2 | 3.1 |
| Tailings | | 4.3 | 150 | 1.5 | 1.8 |
| FEED | | 27.9 | 1,202 | 3.9 | 2.5 |

Distribution %

| PRODUCTS | % WEIGHT | % Pb | Ag. gr/m.t. | % Zinc | % Fe |
|---|---|---|---|---|---|
| Ag and Pb concentrate | 51.0 | 92.46 | 93.87 | 81.15 | 64.27 |
| Tailings | 49.0 | 7.54 | 6.13 | 18.85 | 35.73 |
| FEED | 100.0 | 100.00 | 100.00 | 100.00 | 100.00 |

To enable the objects and features of the invention to be understood more easily, a more detailed description is given below thereof, referring to the attached drawings, in which a preferred form of embodiment is given by way of unlimited example:

DETAILED DESCRIPTION OF A PREFERRED EMBODIMENT

Figure 1:
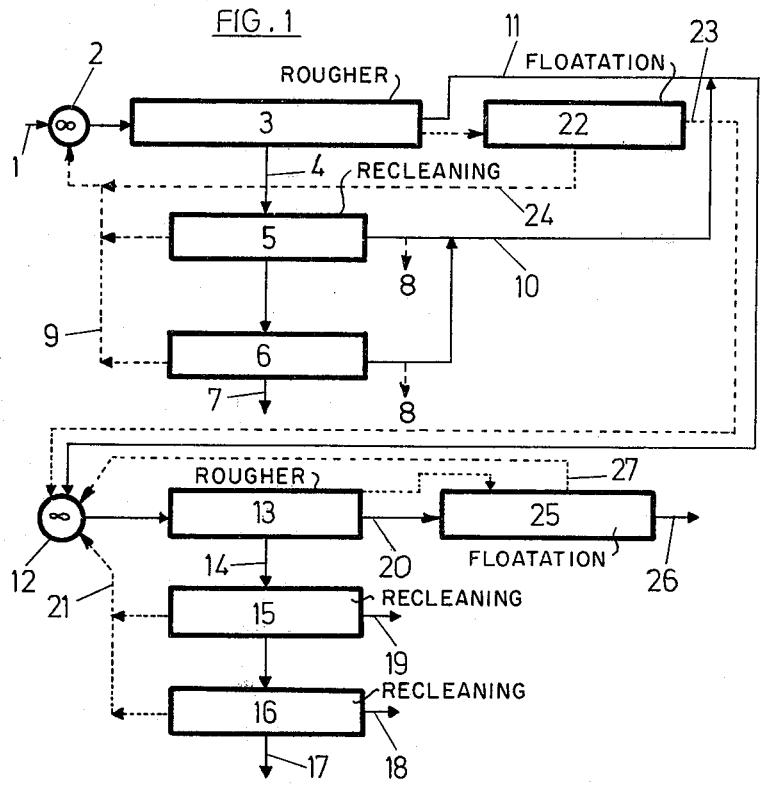
FIG. 1 is a diagram of the process disclosed, in which the silver and lead are floated independently.

As shown in FIG. 1, the residues 1 obtained from an electrolytic zinc plant are inserted in a conditioner 2 where part or all of the collectors are added. From here, these residues pass on to a "rougher" stage 3, where the silver, sulphur and zinc, but not the lead, are floated with no sulphurizing agents. For this, collectors are added which do not float the lead; this stage furthermore takes place in an acid medium. The floated product 4 is subjected to a recleaning operation, in two stages 5 and 6 in the case disclosed, to finally obtain a concentrate 7 rich in silver. During the recleaning operations, it is advisable to keep the acid medium between a pH of 2 and 4.5. The residues of the recleaning stages 5 and 6 can be discarded as tailings, as mentioned with reference 8, or be added, as shown with reference 9, to the conditioner 2.

It is also possible to add the residues of each recleaning stage at the head of the previous one.

Finally, the residue of the recleaning stages 5 and 6 can be added, as shown with reference 10, to the residues 11 of the "rougher" stage 3. During the process disclosed, frothing products can be added, but preferably these products should not have collector properties.

The residues 11 pass to the conditioner 12 where a sulphurizing agent is added, preferably sodium sulphide, designed to activate the lead sulphate. The residues treated in this way are subjected to a "rougher" stage where suitable collectors, such as xanthates and/or dithiophosphates are added, to float the lead. The floated product 14 is recleaned in two stages 15 and 16, in the present case, finally obtaining a concentrate rich in lead 17.

The residues 18, 19 and 20 of stages 16, 15 and 13 can be disregarded as sterile. The residues 18 and 19 can be added, as shown with reference 21, to the conditioner 12.

The residues 11 of the "rougher" stage 3, can be subjected, before the addition of the sulphurizing agent in 12, to a flotation stage 22, whose residue 23 will be that which passes to the conditioner 12, whereas the product floated 24 passes to the conditioner 2.

For their part, the residues 20 of the "rougher" stage 13, can also pass on to a flotation stage 25 giving some sterile residues 26 and a floated product 27 which passes to the conditioner 12.

The sulphurizing agent, collectors and frothing agents can be added gradually in different points of the relevant circuit.

Figure 2:
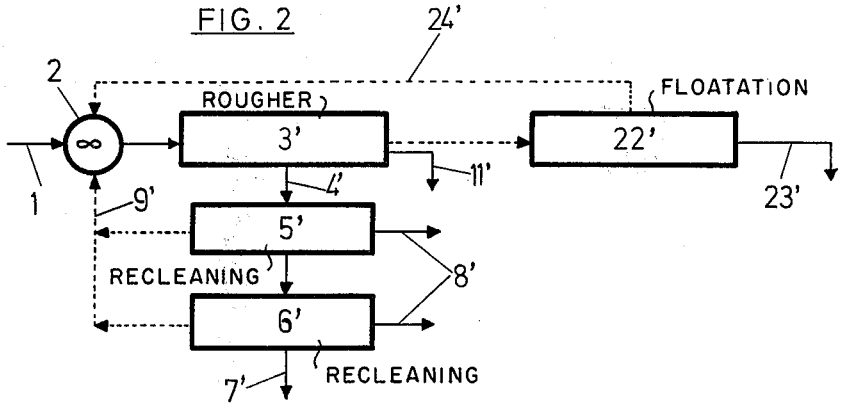
FIG. 2 is a diagram of the process in which the silver and lead are floated together.

In the case of FIG. 2, in the conditioner 2, apart from the afore-mentioned agents, a sulphurizing agent is added, preferably sodium sulphide, so that in the "rougher" 3', apart from the silver, sulphur and zinc, the lead also floats. The floated product 4' is subjected to recleaning 5' and 6', obtaining a concentrate 7' rich in silver and lead. The residues 8' and 11' can be discarded as tailings, or pass the residues 8' as shown with reference 9', to the conditioner 2. For their part, the residues 11' can be subjected to a floatation operation 22' which will give a tailings residue 23' and a floated product 24' which passes to the conditioner 2.

During the process, collector and frothing agents are added, as also can be sulphurizing agents, in several stages throughout said process.

We claim:

1. A flotation process for concentrating lead and silver from electrolytic zinc residues which contain lead sulfate and silver comprising the steps:

subjecting the zinc residue to a "rougher" operation employing collector agents such as xanthates and dithiophosphates and floating in an acid medium most of the silver, sulphur and zinc contained therein:

recleaning said floated product in one to three stages and obtaining a concentrate rich in silver, sulphur and zinc;

treating the residue from said first "rougher" operation with sulphurizing agents to activate the lead component as a pH ranging from 2 to 4.5;

subjecting the sulphurized treated residues to another "rougher" operation wherein said lead and additional silver components are floated;

recleaning said floated product from said treated residues in one to three stages; and recovering said lead and additional silver as a concentrate.

2. Process according to claim 1, wherein sodium sulphide is used as a sulphurizing agent to activate the lead component.

3. Process according to claim 1, wherein the residues from the silver, sulphur and zinc flotation of the recleaning stages are combined with the residues of the silver, sulphur and zinc from the "rougher" operation.

4. Process according to claim 3, wherein the residues from said "rougher" stage are subjected to a flotation operation, whose floated product passes to the head of said "rougher" stage.

5. Process according to claim 1, wherein the residues from said another "rougher" stage are subjected to a flotation operation whose floated product is taken to the head of said another "rougher" stage.

6. Process according to claim 14, wherein the residues of the recleaning stages following the "rougher" stage are taken to the head of their corresponding "rougher" stage.

7. A process for recovering concentrated lead and silver values from electrolytic zinc residues which contain lead sulfate and silver, comprising the steps:

a. acidifying the electrolytic zinc residues in a conditioner with collector agents such as xanthates and dithiophosphates, and a sulfurizing agent to activate the lead component, said acidified residue being at a pH ranging from 2 to 4.5;

b. subjecting the conditioned zinc residues to a "rougher" operation to float silver and lead components;

c. floating the residue from said "rougher" operation and recycling the floated products therefrom to said conditioner;

d. recleaning the recovered floated products from said "rougher" operation in at least one stage; and e. recovering a silver and lead concentrate.

* * * * *

UNITED STATES PATENT AND TRADEMARK OFFICE

CERTIFICATE OF CORRECTION

PATENT NO. : 3,968,032

DATED : July 6, 1976

INVENTOR(S) : Francisco Javier Sitges Menendez et al

It is certified that error appears in the above-identified patent and that said Letters Patent are hereby corrected as shown below:

Column 4, line 28, after "The" delete "floated";

Column 4, line 30, change "recleaning" to --recleaner--;

Column 4, line 34, change "oerations" to --operations--;

Column 4, line 48, before "will" change "sterile" to --tailings--;

Column 4, line 68, change "blends" to --scavenger--;

Column 6, line 1, after "concentrate" change "did not calcine" to --has not been calcined--;

Column 6, line 50, change "residue" to --residues--;

Column 6, line 60, after "stage" insert --13--;

Claim 1, line 14, after "component" change "as" to --at--;

Claim 6, line 1, change "claim 14" to --claim 1--.

Signed and Sealed this

First Day of March 1977

[SEAL]

*Attest:*

RUTH C. MASON
*Attesting Officer*

C. MARSHALL DANN
*Commissioner of Patents and Trademarks*